US009958218B2

(12) United States Patent
Bellenfant et al.

(10) Patent No.: US 9,958,218 B2
(45) Date of Patent: May 1, 2018

(54) HEAT EXCHANGER, HOUSING, AND AIR-CONDITIONING CIRCUIT COMPRISING SUCH AN EXCHANGER

(75) Inventors: Aurelie Bellenfant, Roeze sur Sarthe (FR); Alain Pourmarin, Les Essarts-le-Roi (FR); Fabienne Bedon, Le Mans (FR); Eric Goyet, Arnage (FR); Jean-Christophe Prevost, Ligron (FR); Virginie Vincent, Le Mans (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 212 days.

(21) Appl. No.: 14/128,647

(22) PCT Filed: Jun. 28, 2012

(86) PCT No.: PCT/EP2012/062597
§ 371 (c)(1),
(2), (4) Date: Mar. 5, 2014

(87) PCT Pub. No.: WO2013/001019
PCT Pub. Date: Jan. 3, 2013

(65) Prior Publication Data

US 2014/0224461 A1 Aug. 14, 2014

(30) Foreign Application Priority Data

Jun. 28, 2011 (FR) ..... 11 01980

(51) Int. Cl.
*F28F 9/02* (2006.01)
*F28D 1/053* (2006.01)
*F28D 21/00* (2006.01)

(52) U.S. Cl.
CPC ..... *F28F 9/0214* (2013.01); *F28D 1/05391* (2013.01); *F28F 9/0209* (2013.01); *F28F 9/0256* (2013.01); *F28D 2021/0084* (2013.01)

(58) Field of Classification Search
CPC ..... F28F 9/0204; F28F 9/0209; F28F 9/0221; F28F 9/0246; F28F 9/0282; F28F 9/0263;
(Continued)

(56) References Cited

U.S. PATENT DOCUMENTS 5,582,238 A * 12/1996 Plaschkes ..... F24D 3/142 165/171
6,223,556 B1 * 5/2001 De Keuster ..... F25B 39/04 165/132
(Continued)

FOREIGN PATENT DOCUMENTS

DE 102007003097 A1 * 7/2008 ..... B23K 5/006
EP 0 676 593 A1 10/1995
(Continued)

OTHER PUBLICATIONS

English language abstract for JPH 04-187991 extracted from espacenet.com database on May 19, 2014, 7 pages.
(Continued)

*Primary Examiner* — David Teitelbaum
*Assistant Examiner* — Nelson Nieves
(74) *Attorney, Agent, or Firm* — Howard & Howard Attorneys PLLC

(57) ABSTRACT

A heat exchanger (1) for a motor vehicle includes a plurality of tubes (2) arranged in a first and a second row (3A, 3B); a first and a second header tank (4, 5) inside which tanks (4, 5) the tubes (2) of each of the rows (3A, 3B) emerge; and a longitudinal dividing partition (16) arranged in the first header tank (4) to divide the first header tank (4) longitudinally into refrigerant inlet and outlet compartments (17, 18) into which the tubes (2) of the first row (3A) and of the second row (3B) emerge. The longitudinal dividing partition (16) includes a plurality of transverse dividing partitions (27) arranged in the second header tank (5) to divide the
(Continued)

Figure 1:
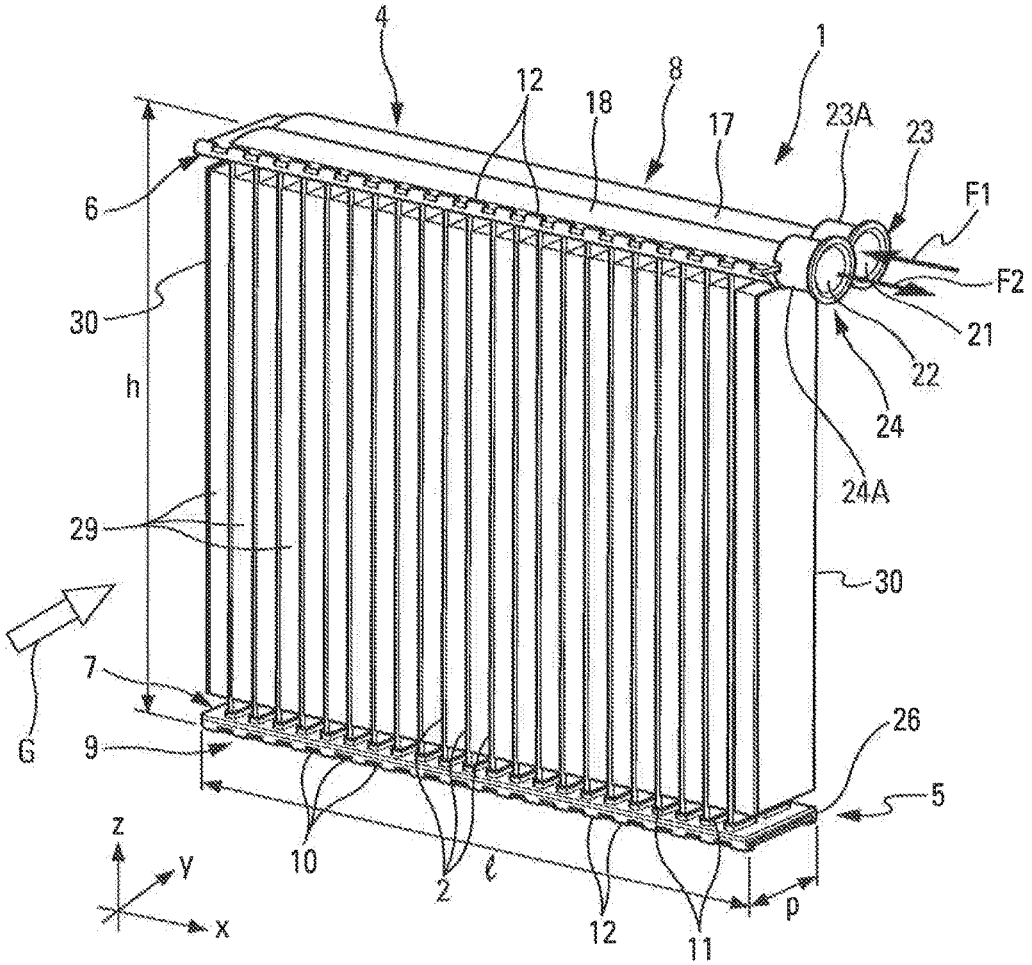

second header tank (5) transversely into a plurality of return compartments (28) into which at least one tube (2) of each of the rows (3A, 3B) emerges.

16 Claims, 3 Drawing Sheets

(58) Field of Classification Search
CPC F28F 9/0243; F28D 1/05366; F28D 1/05391; F28D 1/05375; F28D 1/5383
See application file for complete search history.

(56) References Cited

U.S. PATENT DOCUMENTS

| | | | | |
|---|---|---|---|---|
| 6,749,015 | B2 | 6/2004 | Moreau | |
| 2006/0201198 | A1* | 9/2006 | Nishino | F25B 39/028 62/525 |
| 2007/0131391 | A1* | 6/2007 | Ichiyanagi | F28D 1/0391 165/110 |
| 2007/0144721 | A1* | 6/2007 | Watanabe | F28D 1/05375 165/174 |
| 2007/0169512 | A1* | 7/2007 | Ishizaka | F25B 5/04 62/515 |
| 2009/0173482 | A1* | 7/2009 | Beamer | F28D 1/05383 165/173 |
| 2009/0194095 | A1* | 8/2009 | Fairstein | F24J 2/16 126/652 |
| 2010/0300667 | A1* | 12/2010 | Samuelson | F28D 1/05383 165/175 |
| 2011/0088885 | A1* | 4/2011 | Samuelson | F28D 1/05375 165/176 |
| 2011/0240276 | A1* | 10/2011 | Wintersteen | F28D 1/05383 165/173 |

FOREIGN PATENT DOCUMENTS

| | | | | |
|---|---|---|---|---|
| EP | 1 298 401 | A2 | 4/2003 | |
| EP | 1 460 364 | A2 | 9/2004 | |
| FR | 2803378 | A1 | 7/2001 | |
| JP | H 04-187991 | A | 7/1992 | |
| JP | 2003-207294 | A | 7/2003 | |
| WO | WO 2005090892 | A1 * | 9/2005 | F28F 9/0246 |

OTHER PUBLICATIONS

English language abstract and machine-assisted English translation for JP 2003-207294 extracted from PAJ database on May 19, 2014, 30 pages.
International Search Report for Application No. PCT/EP2012/062597 dated Oct. 12, 2012, 5 pages.
English language abstract for FR 2803378 from espacenet.com database on Dec. 10, 2015, 24 pages.

* cited by examiner

HEAT EXCHANGER, HOUSING, AND AIR-CONDITIONING CIRCUIT COMPRISING SUCH AN EXCHANGER

RELATED APPLICATIONS

This application is the National Stage of International Patent Application No. PCT/EP2012/062597, filed on Jun. 28, 2012 which claims priority to and all the advantages of French Patent Application No. FR 11/01980, filed on Jun. 28, 2011, the content of which is incorporated herein by reference.

The present invention relates to a heat exchanger, for example used as a condenser in a heating, ventilation and/or air conditioning installation for a motor vehicle interior. The invention also relates to a heating, ventilation and/or air conditioning installation housing and to an air conditioning circuit comprising such a heat exchanger.

Document EP-1460364 discloses an interior heat exchanger (also referred to as an "inner condenser") which comprises a core bundle with two rows of tubes. For each row of tubes, one of the ends of the tubes is received into a header tank, while the opposite end is connected in fluidic communication with one or more tubes of the other row. This fluidic connection can be achieved:

- either using two additional header tanks which respectively accept the ends of the first and of the second rows of tubes, these header tanks being connected to one another, at their longitudinal ends, by two connecting pipes. However, leaving aside its obvious weakness, connecting the additional header tanks is a complex operation to perform and gives rise to non-insignificant pressure drops which disrupt and impair the efficiency of the internal exchanger;
- or by bending over tubular elements so as to obtain, from each tubular element, two tubes, one of which belongs to the first row and the other to the second. However, when the set overall size is reduced, bending over the tubes appreciably reduces the "useful" height of the core bundle of tubes, i.e. the height of tubes devoted to the exchange of heat. This is because part of the height of the tubes is sacrificed to the bending-over, and this detracts from the thermal efficiency of the internal exchanger.

Moreover, document EP-1298401 discloses a front end heat exchanger comprising a plurality of tubes, in each of which one or more ducts for the circulation of a refrigerant is or are made, which tubes are set out as a core bundle in a first and a second row of tubes facing one another, and a first and a second header tank into which the tubes of each of the said rows emerge. A first longitudinal dividing partition, arranged in the first header tank, longitudinally divides this tank into:

- a refrigerant inlet compartment into which the tubes of the first row emerge, thus providing fluidic communication between the ducts of the tubes of the first row; and
- a refrigerant outlet compartment, adjacent to the inlet compartment, into which the tubes of the second row emerge, providing fluidic communication between the ducts of the tubes of the second row.

A second longitudinal dividing partition, arranged in the second header tank, divides the latter longitudinally into two fluid return compartments. The second partition is multiperforated so as to place the two return compartments in fluidic communication.

Nevertheless, the small cross section of the perforations in the second partition causes significant pressure drops which impair the efficiency of the heat exchanger. Furthermore, the plurality of perforations weakens the structure of the second header tank, thereby adversely affecting the robustness of the heat exchanger as a whole. As a consequence, any increase in the number or dimensions of the perforations would further weaken the structure of the exchanger.

It is an object of the present invention to overcome these disadvantages and notably to provide a front end or internal heat exchanger that offers minimum pressure drops and satisfactory thermal performance, particularly uniformity of the temperature of the flow of air leaving the exchanger in the case of an internal exchanger.

To this end, according to the invention, the heat exchanger comprising:

- a plurality of tubes, arranged in a first and a second row, and through which a refrigerant is intended to circulate;
- a first and a second header tank inside which tanks the tubes of each of the said rows emerge;
- a longitudinal dividing partition arranged in the first header tank to divide it longitudinally into:
  - a refrigerant inlet compartment into which the tubes of the first row emerge; and
  - a refrigerant outlet compartment into which the tubes of the second row emerge, is notable in that it comprises a plurality of transverse dividing partitions arranged in the second header tank to divide it transversely into a plurality of return compartments into which at least one tube of the first row and one tube of the second row emerge.

The partitions are transverse insofar as they extend in a direction perpendicular to a front end of the exchanger, the said front end receiving the flow of air with which the refrigerant exchanges heat.

Thus, by virtue of the invention, the refrigerant intended to circulate through the heat exchanger is distributed uniformly through the tubes of the first row by the fluid inlet compartment. Having passed through the tubes of the first row, the refrigerant is guided into the tubes of the second row, opposite, by the corresponding return compartments. Having arrived in the outlet compartment, the refrigerant is removed out of the heat exchanger. Use of a plurality of return compartments makes it possible to improve the distribution of the fluid in the tubes, and therefore improve the efficiency of the exchanger notably by making the temperature of the air leaving this exchanger more uniform, while at the same time reducing the pressure drops that are liable to detract from the performance of the exchanger, the return compartments advantageously being dimensioned to minimize these pressure drops. In addition, the amount of space occupied by such an exchanger is appreciably reduced and the rigidity of the exchanger is improved by the presence of a plurality of transverse partitions.

In other words, the invention makes it possible to optimize the thermal performance of the heat exchanger in relation to a dictated overall size, particularly when the heat exchanger needs to be incorporated into a heating, ventilation and/or air conditioning housing, the heat exchanger in the latter being an internal heat exchanger.

Preferably, the return compartments have identical dimensions to one another, such that they all accept the same number of tubes of the first and of the second rows. It will be noted that each return compartment may accommodate one or a plurality of tubes of each of the two rows.

In one embodiment of the invention, the first and second header tanks each comprise a bottom plate comprising a plurality of orifices that accept the corresponding tubes, and a cover attached to the said bottom plate; and the cover of the first header tank takes the form of a pressed metal plate defining the inlet compartment and the outlet compartment.

According to this embodiment, a portion of the said metal plate is in sealed contact with the corresponding bottom plate to form the longitudinal dividing partition. Of course, in an alternative form, the longitudinal dividing partition may be separate from and independent of the cover and intercalated between the latter and the bottom plate.

For preference, the contour of each of the orifices in the bottom plate is surmounted by an external collar, i.e. which extends towards the outside from an internal volume defined by the header tank for securing the corresponding tube.

Thus, by virtue of the collars, the longitudinal ends of the tubes penetrate little, if at all, into the inlet, outlet or return compartments, as the case may be, and this:

reduces disturbance to the flow of refrigerant by limiting turbulence;

avoids the appearance of pressure drops and problems with supply of liquid to the tubes; and allows the size of the header tanks to be reduced.

Advantageously:

the bottom plate of the first header tank comprises two semicircular deformations arranged respectively facing the longitudinal ends of the inlet and outlet compartments; and the bottom of the semicircular deformations is connected to the face of the bottom plate that faces towards the cover by an intermediate connecting zone which, in axial section, has a predetermined curvature comprising a point of inflection.

Thus, such semicircular deformations encourage the refrigerant to flow at the inlet/outlet of the first header tank by preventing the formation of turbulence caused by stream line separation. Further, the pressure drops caused by the geometry of this zone are reduced.

Still according to this embodiment, the cover of the second header tank takes the form of a pressed metal plate defining the return compartments.

Advantageously, portions of the said metal plate are in sealed contact with the corresponding bottom plate to form the transverse dividing partitions. Once again, as an alternative, the transverse dividing partitions may be distinct from and independent of the cover and intercalated between the latter and the bottom plate.

Moreover, the heat exchanger preferably comprises a refrigerant inlet nozzle and a refrigerant outlet nozzle which are respectively in fluidic communication with the inlet compartment and the outlet compartment.

In particular, the inlet and outlet nozzles may each comprise a lateral skirt attached to an exterior face of the first header tank, which makes the exchanger easier to preassemble prior to brazing, notably by keeping the bottom plate and the cover of the first header tank together.

In addition, the heat exchanger advantageously comprises corrugated separators arranged in such a way that each separator is intercalated between two adjacent tubes of the first row and extends between the two adjacent tubes opposite belonging to the second row.

For preference, the tubes of the first and second rows extend in the vertical direction, so as to minimize temperature differences in the air leaving the heat exchanger. In the case of an internal exchanger, such an orientation makes it easier to remove water that condenses on an external face of the tubes. This is because gravity and the vertical nature of the tubes when the internal exchanger is installed in the ventilation installation encourages this water to flow.

Moreover, the invention also relates to a housing of a heating, ventilation and/or air conditioning installation in particular for a motor vehicle interior, comprising a heat exchanger of the type described hereinabove.

The present invention further relates to an air conditioning circuit through which there circulates a refrigerant, comprising at least a compressor, an external heat exchanger, an evaporator and an internal heat exchanger as detailed hereinabove.

The figures of the attached drawing will make it easy to understand how the invention may be embodied. In these figures, identical references denote elements that are similar.

FIG. 1 depicts, in a schematic perspective view, one exemplary embodiment of a heat exchanger according to the present invention, once it has been assembled.

Figure 2:
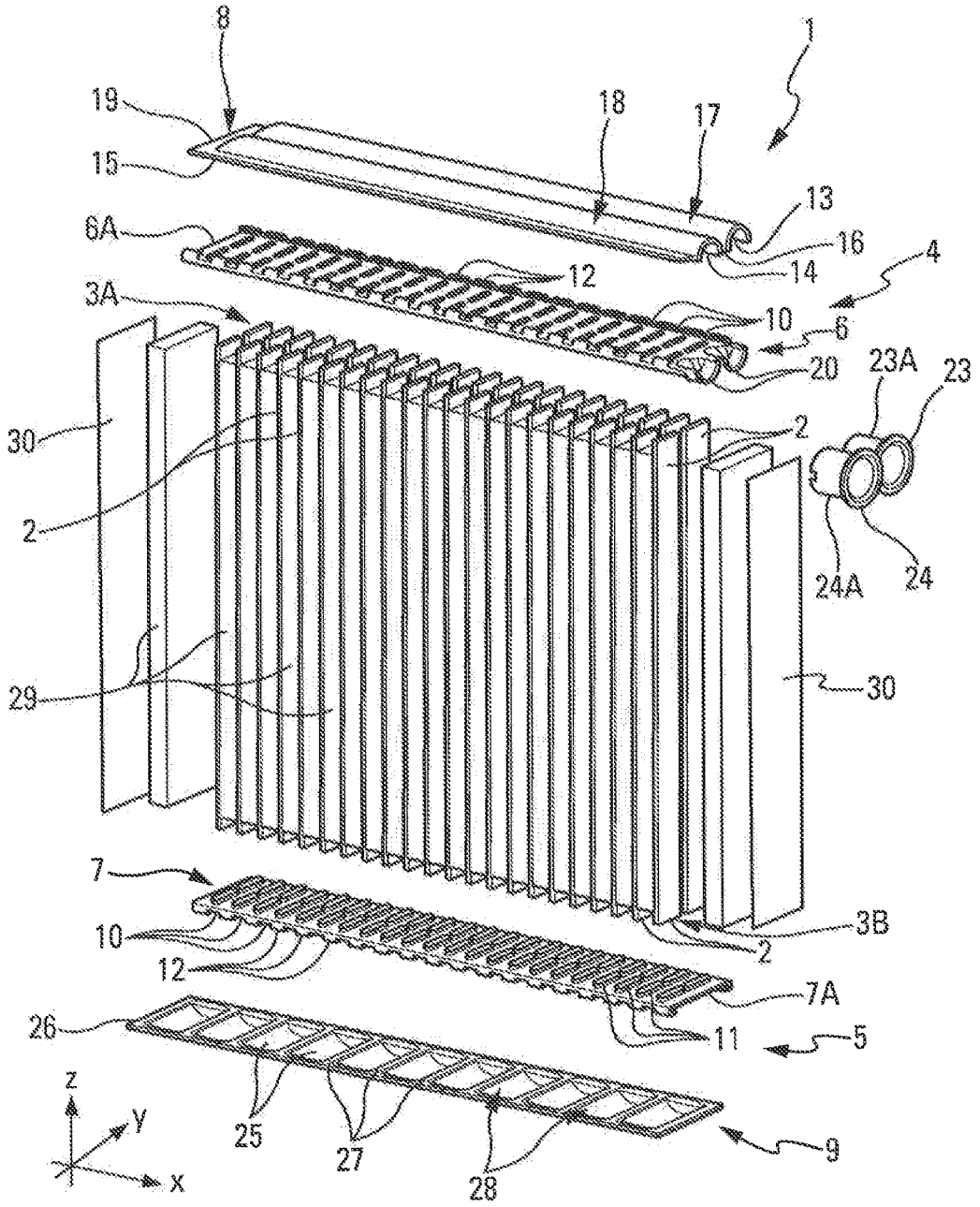

FIG. 2 schematically illustrates, in an exploded perspective view, the heat exchanger of FIG. 1.

Figure 3:
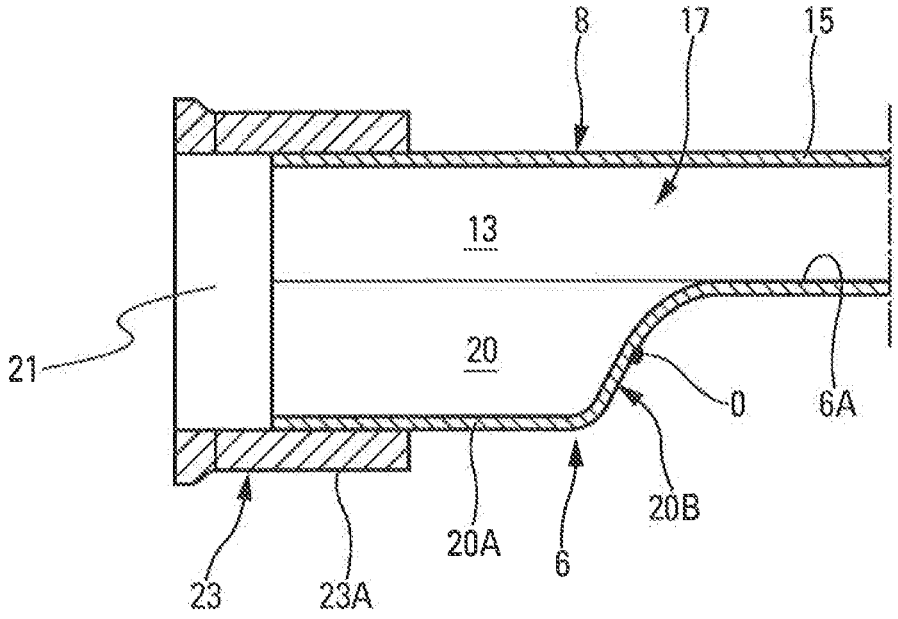

FIG. 3 is a partial axial section through a longitudinal end of the inlet compartment of the heat exchanger of FIG. 1.

FIGS. 1 and 2 depict one exemplary embodiment of a heat exchanger 1 according to the present invention. In one particular application of the present invention, the heat exchanger 1 is an inner condenser incorporated into a motor vehicle air conditioning circuit (not depicted in the figures) operating at least in a heat pump mode, the inner condenser being placed inside a housing of the heating, ventilation and/or air conditioning installation of the vehicle (none of which have been depicted).

It will be noted that, as an alternative, such a heat exchanger could also be used as a vehicle front end heat exchanger, provided that modifications relating notably to the dimensions of the structure of the exchanger are made.

As these figures show, the heat exchanger 1, which extends over a width 1 in a longitudinal direction x, over a depth p in a transverse direction y perpendicular to the longitudinal direction x, and over a height h in a vertical direction z perpendicular to the longitudinal direction x and to the transverse direction y, comprises a core bundle of tubes which is formed of a plurality of longitudinal tubes 2, extending in the vertical direction z, through which a refrigerant from the air conditioning circuit can pass.

It should be noted that the tubes 2 could alternatively be arranged horizontally or even at any angle of inclination, the vertical direction being the preferred direction for the interior exchanger mounted inside the housing of the vehicle ventilation installation. The vertical or horizontal direction of an element, particularly the tubes, is determined with reference to the position that the exchanger may adopt once it has been installed in the vehicle, it being possible for such a position to be assessed without necessarily placing the exchanger in the vehicle.

The tubes 2 are distributed among a first row 3A and a second row 3B which are parallel to one another and arranged one behind the other in the transverse direction y. Thus, each row of tubes 3A, 3B comprises a plurality of tubes 2 which are evenly distributed in the longitudinal direction x.

The heat exchanger 1 also comprises a first and a second header tank 4 and 5, of a shape that is elongate in the longitudinal direction x, inside which the tubes 2 of each of the said rows 3A and 3B emerge. The two longitudinal ends of the tubes 2 are therefore housed respectively in the first header tank 4 and in the second header tank 5.

The first and second header tanks 4 and 5 each comprise a bottom plate 6, 7 and a cover 8, 9 attached to the latter.

The bottom plate 6, 7 and the cover 8, 9 of each of the header tanks 4, 5 have a rectangular shape and extend lengthwise in the longitudinal direction x and widthwise in the transverse direction y.

Each bottom plate 6, 7, made of a metallic material, comprises a flat contact face 6A, 7A, against which the corresponding cover 8, 9 is mounted, which face is pierced with a plurality of through-orifices 10 distributed in a first and a second row that are parallel and extend in the longitudinal direction x.

The cross section of the orifices 10 corresponds to the external cross section of the tubes 2 so that the longitudinal end of each of the tubes 2 can, at least in part, pass through the corresponding orifice 10 in the bottom plate 6, 7.

Furthermore, the contour of each of the orifices 10 in the bottom plates 6 and 7 is surmounted by an external collar 11, the internal cross section of which is more or less identical to that of the orifice 10 it extends so that the corresponding tube 2 can be attached securely. Each collar 11 extends, in the vertical direction z, outside the corresponding header tank 4, 5.

In addition, each bottom plate 6, 7 comprises a plurality of attachment tabs 12, uniformly distributed along its lateral edges, which are folded over onto the lateral edges of the corresponding cover 8, 9.

Moreover, the cover 8 of the first header tank 4 has a first and a second longitudinal recess 13 and 14, otherwise known as a longitudinal deformation, which are parallel to one another and extend in the longitudinal direction x. The two adjacent recesses 13 and 14 have a cross section of semicircular shape.

The longitudinal recesses 13 and 14 may be produced by pressing a metal plate 15 which, once pressed, forms the cover 8 of the first header tank 4.

The first longitudinal recess 13 is separated from the second longitudinal recess 14 by a longitudinal dividing partition 16 extending in the direction x. In particular, this longitudinal partition 16 is formed by a portion of the metal plate 15 that is kept in sealed contact with the corresponding bottom plate, for example by brazing. In other words, the longitudinal dividing partition 16 corresponds to a non-pressed longitudinal portion of the metal plate 15 that forms the cover 8.

Thus, when the cover 8 of the first header tank 4 is secured to the corresponding bottom plate 6, the first and second longitudinal recesses 13 and 14 respectively define a refrigerant inlet compartment 17 into which the tubes 2 of the first row 3A emerge, and a refrigerant outlet compartment 18, adjacent to the inlet compartment 17, into which the tubes 2 of the second row 3B emerge. In other words, the orifices 10 of the first row of the bottom plate 6 open into the inlet compartment 17, while those of the second row open into the outlet compartment 18.

One of the longitudinal ends of the first and second recesses 13 and 14 is open and opens into one of the longitudinal ends of the cover 8, the opposite longitudinal end being closed by a transverse partition 19 formed by a non-pressed portion of the metal plate 15 in sealed contact with the bottom plate 6.

Moreover, the bottom plate 6 of the first header tank 4 comprises two gutters, otherwise known as semicircular deformations 20, arranged respectively facing the longitudinal ends of the inlet 17 and outlet 18 compartments. Each of the semicircular deformations 20, produced for example by pressing the bottom plate 6, runs longitudinally over a reduced portion of this plate and has a cross section of semicircular shape, the internal diameter of which is identical to that of the longitudinal recesses 13 and 14.

Thus, when the bottom plate 6 and the cover 8 of the first header tank 4 are assembled together, the longitudinal recesses 13 and 14 find themselves respectively facing the semicircular deformations 20 so as to delimit a refrigerant inlet 21 or outlet 22 duct with circular internal and external cross sections.

Furthermore, the heat exchanger 1 comprises a refrigerant inlet nozzle 23 and a refrigerant outlet nozzle 24 which are respectively in fluidic communication with the inlet compartment 17 and the outlet compartment 18 so as to allow the heat exchanger 1 to be connected up to the refrigerant circuit. The inlet 23 and outlet 24 nozzles each comprise a lateral skirt 23A, 24A attached to an exterior face of the inlet 21 and outlet 22 ducts of the first header tank 4, at one of the longitudinal ends thereof. It will thus be appreciated that the lateral skirt 23A, 23B has an internal diameter equal to the external diameter of the assembly formed by the longitudinal recess 13, 14 pressed against or up close to the relevant semicircular deformation 20.

As FIG. 3 schematically shows, the bottom 20A of the semicircular deformations 20 is connected to the face of the bottom plate 6 that faces towards the cover 8 by an intermediate connecting zone 20B which, in axial section, has a predetermined curvature comprising a point of inflection O.

Moreover, the cover 9 of the second header tank 5 has a plurality of identical transverse recesses 25 parallel to one another and which run in the transverse direction y. The transverse recesses 25 have a cross section of substantially semicircular shape. They can be achieved by pressing a metal plate 26 which, once pressed, forms the cover 9 of the second header box 5.

Furthermore, the transverse recesses 25 are separated from one another by transverse dividing partitions 27 extending in the direction y. In particular, each transverse partition 27 is formed by a portion of the metal plate 26 kept in sealed contact with the corresponding bottom plate 7. In other words, the transverse dividing partitions 27 each correspond to an unpressed longitudinal portion of the metal plate 26 that forms the cover 9.

Once the cover 9 of the second header box 5 has been fixed to the associated bottom plate 7, the transverse recesses 25 define refrigerant return compartments 28 into which two tubes 2 of the first row 3A and two tubes 2 of the second row 3B emerge. It goes without saying that the number of tubes 2 of the first row 3A and of the second row 3B that emerge into each return compartment 28 may be less than or greater than two.

Each return compartment 28 has no fluidic communication with the adjacent return compartment or compartments 28.

Thus, each return compartment 28 places two tubes 2 of the first row 3A in fluidic communication with the two tubes 2 opposite them belonging to the second row 3B. The cross section of the return compartments 28 is advantageously determined so that the pressure drops suffered by the fluid passing through the heat exchanger 1 are minimized.

Moreover, the heat exchanger 1 also comprises corrugated separators 29 formed of a plurality of heat exchanger fins. Each corrugated separator 29 is intercalated between two adjacent tubes 2 of the first row 3A and extends between the two adjacent tubes 2 opposite belonging to the second row 3B. Brazed contact is maintained between the corrugated separator 29 and the corresponding tubes 2 which flank it in order to facilitate heat exchange.

As an exception, the separators 29 intercalated at the ends of the core bundle of tubes 2 are in contact with just one tube 2 of the first row 3A and of the second row 3B and with an end plate 30 that provides the structure of the heat exchanger 1 with greater stiffness.

By virtue of the invention, the refrigerant circulating through the heat exchanger 1 is distributed uniformly through the tubes 2 of the first row 3A by the inlet compartment 17 having been introduced into this compartment by the inlet nozzle 23, as depicted symbolically by the arrow F1.

Once it has finished passing through the tubes 2 of the first row 3A, the refrigerant is guided into the tubes 2 of the second row 3B by the corresponding return compartments 28.

The refrigerant then passes through the tubes 2 of the second row 3B to arrive in the outlet compartment 18 via which it is finally discharged out of the heat exchanger 1 having passed through the outlet nozzle 24 as the arrow F2 illustrates.

In other words, according to the invention, the circulation of refrigerant through the heat exchanger 1 is a two-pass circulation, the first pass corresponding to the passage through the first row of tubes 3A, the second pass corresponding to the passage through the second row 3B, the air depicted symbolically by the arrow G passing, in this order, through the second row of tubes 3B then the first row of tubes 3A. In this way, internal pressure drops are limited notably by comparison with a four-pass heat exchanger, while uniformity of temperature across the front face of the exchanger is maintained making the exchanger compatible with and useable in a setup in a housing of a vehicle ventilation installation.

Advantageously, the heat exchanger 1 comprises fixing means (not depicted in the figures) which, once the heat exchanger is installed in a housing of a heating, ventilation and/or air conditioning installation, allow its tubes to be kept vertical.

The invention claimed is:

1. A heat exchanger (1) comprising:

a plurality of tubes (2), arranged in a first and a second row (3A, 3B), and through which a refrigerant is intended to circulate;

a first and a second header tank (4, 5) inside which tanks (4, 5) the tubes (2) of each of the rows (3A, 3B) emerge;

a longitudinal dividing partition (16) arranged in the first header tank (4) to divide the first header tank (4) longitudinally into:

a refrigerant inlet compartment (17) into which the tubes (2) of the first row (3A) emerge; and a refrigerant outlet compartment (18) into which the tubes (2) of the second row (3B) emerge;

wherein the first header tank (4) comprises a bottom plate (6) having a rectangular shape and comprising a plurality of orifices (10) that accept the corresponding tubes (2);

wherein the bottom plate (6) of the first header tank (4) comprises two semicircular deformations (20) arranged respectively facing the longitudinal ends of the inlet and outlet compartments (17, 18) and having a bottom (20A);

wherein the bottom (20A) of the semicircular deformations (20) is connected to a face (6A) of the bottom plate (6) that faces towards a cover (8) by an intermediate connecting zone (20B) which, in axial section, has a predetermined curvature comprising a point of inflection (O);

wherein one of the semicircular deformations (20) corresponds to a first flow path for an inlet duct (21) and another of the semicircular deformations (20) corresponds to a second flow path different from the first flow path for an outlet duct (22); and wherein the second header tank (5) comprises a plurality of transverse dividing partitions (27) arranged in the second header tank (5) to divide the second header tank (5) transversely into a plurality of return compartments (28) into which at least one tube (2) of the first row (3A) and one tube (2) of the second row (3B) emerge.

2. The heat exchanger (1) according to claim 1, in which the return compartments (28) have identical dimensions to one another.

3. The heat exchanger (1) according to claim 1, in which:

the second header tank (5) comprises a bottom plate (7) having a rectangular shape and comprising a plurality of orifices (10) that accept the corresponding tubes (2), wherein the second header tank comprises a cover (9) attached to the bottom plate (7); and wherein the cover (8) of the first header tank (4) takes the form of a pressed metal plate (15) defining the inlet compartment (17) and the outlet compartment (18).

4. The heat exchanger (1) according to claim 3, in which a portion of the metal plate (15) is in sealed contact with the corresponding bottom plate (6) to form the longitudinal dividing partition (16).

5. The heat exchanger (1) according to claim 3, in which the contour of each of the orifices (10) in the bottom plates (6, 7) is surmounted by an external collar (11) for securing the corresponding tube (2).

6. The heat exchanger (1) according to claim 3, in which the cover (9) of the second header tank (5) takes the form of a pressed metal plate (26) defining the return compartments (28).

7. The heat exchanger (1) according to claim 6, in which portions of the metal plate (26) are in sealed contact with the corresponding bottom plate (7) to form the transverse dividing partitions (27).

8. The heat exchanger (1) according to claim 1 further comprising a refrigerant inlet nozzle (23) and a refrigerant outlet nozzle (24) which are respectively in fluidic communication with the inlet compartment (17) and the outlet compartment (18), the inlet 23 and outlet 24 nozzles each comprising a lateral skirt (23A, 24A) attached to an exterior face of the first header tank (4).

9. The heat exchanger (1) according to claim 1 further comprising corrugated separators (29) arranged in such a way that each separator (29) is intercalated between two adjacent tubes (2) of the first row (3A) and extends between the two adjacent tubes (2) belonging to the second row (3B).

10. The heat exchanger (1) according to claim 1, in which the tubes (2) of the first and second rows (3A, 3B) extend in the vertical direction.

11. The housing of a heating, ventilation and/or air conditioning installation for a motor vehicle interior, the housing comprising a heat exchanger (1) as specified in claim 1.

12. An air conditioning circuit through which there circulates a refrigerant, the circuit comprising at least a compressor, an external heat exchanger, an evaporator, and the heat exchanger (1) as specified in claim 1.

13. The heat exchanger (1) according to claim 2, in which:

the second header tank comprises (5) a bottom plate (7) comprising a plurality of orifices (10) that accept the corresponding tubes (2), wherein each of the first and second header tanks comprise a cover (8, 9) attached to the bottom plate (6, 7); and the cover (8) of the first header tank (4) takes the form of a pressed metal plate (15) defining the inlet compartment (17) and the outlet compartment (18).

14. The heat exchanger (1) according to claim 13, in which a portion of the metal plate (15) is in sealed contact with the corresponding bottom plate (6) to form the longitudinal dividing partition (16).

15. The heat exchanger (1) according to claim 1 wherein the face (6A) of the bottom plate (6) is flat, and wherein the cover (8) is mounted against the face (6A).

16. A heat exchanger (1) comprising:

a plurality of tubes (2), arranged in a first and a second row (3A, 3B), and through which a refrigerant is intended to circulate;

a first and a second header tank (4, 5) inside which tanks (4, 5) the tubes (2) of each of the rows (3A, 3B) emerge;

a longitudinal dividing partition (16) arranged in the first header tank (4) to divide the first header tank (4) longitudinally into:

a refrigerant inlet compartment (17) into which the tubes (2) of the first row (3A) emerge; and a refrigerant outlet compartment (18) into which the tubes (2) of the second row (3B) emerge;

wherein the first header tank (4) comprises a bottom plate (6) having a rectangular shape and comprising a plurality of orifices (10) that accept the corresponding tubes (2);

wherein the bottom plate (6) of the first header tank (4) comprises two semicircular deformations (20) arranged respectively facing the longitudinal ends of the inlet and outlet compartments (17, 18) and having a bottom (20A);

wherein the bottom (20A) of the semicircular deformations (20) is connected to a face (6A) of the bottom plate (6) that is flat and faces towards a cover (8) by an intermediate connecting zone (20B) which, in axial section, has a predetermined curvature comprising a point of inflection (O);

wherein one of the semicircular deformations (20) corresponds to a first flow path for an inlet duct (21) and another of the semicircular deformations (20) corresponds to a second flow path different from the first flow path for an outlet duct (22); and wherein the second header tank (5) comprises a plurality of transverse dividing partitions (27) arranged in the second header tank (5) to divide the second header tank (5) transversely into a plurality of return compartments (28) into which at least one tube (2) of the first row (3A) and one tube (2) of the second row (3B) emerge;

wherein the second header tank comprises a cover (9) that takes the form of a pressed metal plate (26) defining return compartments (28), and in which portions of the metal plate (26) are in sealed contact with the corresponding bottom plate (7) to form the transverse dividing partitions (27); and wherein the cover (8) of the first header tank (4) takes the form of a pressed metal plate (15) defining the inlet compartment (17) and the outlet compartment (18).

* * * * *